US006555301B2

(12) United States Patent
Smith et al.

(10) Patent No.: US 6,555,301 B2
(45) Date of Patent: Apr. 29, 2003

(54) PHOTOGRAPHIC SILVER HALIDE MATERIAL WITH MATTE SUPPORT

(75) Inventors: Dennis E. Smith, Rochester, NY (US); Patrick M. Lynch, Rochester, NY (US); Pedro R. Quinones, Fort Collins, CO (US); Eric J. Adsit, Fort Collins, CO (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/191,629

(22) Filed: Jul. 9, 2002

(65) Prior Publication Data

US 2003/0039929 A1 Feb. 27, 2003

Related U.S. Application Data

(63) Continuation-in-part of application No. 09/932,336, filed on Aug. 17, 2001, now abandoned.

(51) Int. Cl.[7] ..... G03C 1/93; G03C 1/76; G03C 1/795; G03C 1/765

(52) U.S. Cl. ..... 430/434; 430/496; 430/523; 430/533; 430/534; 430/535; 430/536; 430/537; 430/539; 430/950

(58) Field of Search ..... 430/950, 537, 430/523, 533, 534, 535, 536, 496, 434, 539

(56) References Cited

U.S. PATENT DOCUMENTS

| | | | | |
|---|---|---|---|---|
| 4,409,322 A | | 10/1983 | Ezaki et al. | 430/950 |
| 4,447,525 A | | 5/1984 | Vallarino et al. | 430/950 |
| 4,677,050 A | | 6/1987 | Yokoyama et al. | 430/530 |
| 5,252,445 A | | 10/1993 | Timmerman et al. | 430/950 |
| 5,342,733 A | | 8/1994 | Kanetake et al. | 430/950 |
| 5,380,637 A | | 1/1995 | Yamishita et al. | 430/950 |
| 5,441,860 A | | 8/1995 | Fornasari et al. | 430/950 |
| 5,445,915 A | * | 8/1995 | Vaes | 430/950 |
| 5,563,226 A | | 10/1996 | Muehlbauer et al. | 526/173 |
| 5,643,972 A | * | 7/1997 | Wang et al. | 430/950 |
| 5,753,425 A | | 5/1998 | Vandenabeele et al. | 430/950 |
| 5,834,174 A | | 11/1998 | Smith et al. | 430/950 |
| 5,965,339 A | | 10/1999 | Smith et al. | 430/950 |
| 6,043,010 A | | 3/2000 | Hokazono et al. | 430/950 |
| 6,110,659 A | * | 8/2000 | Hatekeyama et al. | 430/950 |
| 6,190,821 B1 | * | 2/2001 | Vandenabeele | 430/950 |
| 2002/0037483 A1 | * | 3/2002 | Claes et al. | 430/950 |

FOREIGN PATENT DOCUMENTS

| | | |
|---|---|---|
| JP | 7-261332 | 10/1995 |

* cited by examiner

*Primary Examiner*—Richard L. Schilling
(74) *Attorney, Agent, or Firm*—J. Lanny Tucker

(57) ABSTRACT

Photographic silver halide materials are prepared in a more economical and environmentally acceptable manner by using a specific matting agent in a adhesion-promoting layer between a polymeric support and one or more silver halide emulsion layers. The matting agent has an average particle size of at least 1 $\mu$m and up to about 10 $\mu$m and a glass transition temperature of at least 120° C. Specific matting agents are composed of a polymer represented by the following Structure I:

$$-(A)_x-(B)_y- \qquad \text{I}$$

wherein A represents recurring units derived from one or more polyfunctional ethylenically unsaturated polymerizable monomers, and B represents recurring units derived from one or more monofunctional ethylenically unsaturated polymerizable monomers, x is from about 5 to 100 weight %, and y is from 0 to about 95 weight %.

25 Claims, No Drawings

PHOTOGRAPHIC SILVER HALIDE MATERIAL WITH MATTE SUPPORT

CROSS-REFERENCE TO RELATED APPLICATIONS

This is a Continuation-In-Part of application Ser. No. 09/932,336, filed Aug. 17, 2001 entitled "PHOTOGRAPHIC SILVER HALIDE MATERIAL WITH MATTE SUPPPORT" by Dennis E. Smith, Patrick M. Lynch, Pedro R. Quinones, and Eric J. Adsit, now abandoned.

FIELD OF THE INVENTION

This invention relates to photographic silver halide materials, and particularly to photographic silver halide materials that contain a matting agent on either or both sides of the support. This invention also relates to a method of providing an image using such photographic silver halide materials.

BACKGROUND OF THE INVENTION

It is conventional to incorporate fine particles of polymers or inorganic materials into the surface protective layers of photographic materials to increase surface roughness. This reduces the possibility that various materials will stick to each other or to processing equipment, and improves anti-static properties. Useful surface matting agent prepared from various crosslinked organic polymers are described, for example, in U.S. Pat. No. 5,342,733 (Kanetake et al.). Additional surface matting agents prepared from a crosslinked polymer latex are also described in U.S. Pat. No. 5,380,637 (Yamashita et al.).

Useful matting agents that exhibit improved adhesion in hydrophilic colloid layers are described in U.S. Pat. No. 5,563,226 (Muehlbauer et al.). Crosslinked matting agents for use in surface layers of photographic silver halide materials are described in U.S. Pat. No. 5,834,174 (Smith et al.) and U.S. Pat. No. 5,965,339 (Smith et al.).

It is also conventional to include matting agent in protective layers on either or both sides of a photographic material. For example, one surface protective layer is disposed over the one or more silver halide emulsion layers disposed on a support while another surface matte layer can be disposed on the "backside" of the support and over either emulsion layers or light-insensitive layers such as pelloid or anti-curl layers, as described for example in U.S. Pat. No. 4,409,322 (Ezaki et al.).

A number of commercial photographic film products have been manufactured and sold that include a non-crosslinked matting agent underneath the silver halide emulsion layers. Such matting agents are generally included in what is known as a hydrophilic subbing layer that is applied to subbed or unsubbed polymer film supports. When the film supports are coated in this matter, they can be more readily transported and handled for application of additional layers without static buildup. Such matting agents include non-crosslinked polymeric particles having an average particle size of about 1 to 2 $\mu$m and a glass transition temperature of from about 100° C. to about 105° C.

In addition, commercial films (for example, KODAK X-OMAT 2 Dental Duplicating Film) are known that comprise crosslinked matting age beneath the silver halide emulsion layers but the average size of the matting agent particles is about 0.5–0.8 $\mu$m. Such particles are generally inferior in reducing static buildup and have minimal crosslinking (up to 2 weight %) and are not useful in every manufacturing situation.

Photographic film base (or support) is often coated with various light-insensitive subbing layers, and the "subbed" polymeric supports may be heat treated to provide dimensional stability prior to application of the silver halide formulations. In certain situations, one or more subbing layers may include matting agents for improved web transport and improved electrical conductivity. The conditions of manufacture have become increasing severe in recent years because of the need for increased manufacturing speeds and the use of higher temperature.

It has been found that during such procedures, some matting agents are softened from the heat treatment and tend to flake off the coated support and to collect on transport rollers and other equipment. This debris increases with manufacturing speed and necessitates frequent equipment cleaning and downtime. In addition, the buildup of matting agent on the transport rollers may cause indentations or "impressions" in a passing web that create physical and image defects and other abnormalities during and after silver halide emulsion layers have been applied. The present invention is designed to address these concerns.

SUMMARY OF THE INVENTION

The present invention solves the problems noted above with a photographic silver halide material comprising a polymeric support and having on at least one side thereof, one or more silver halide emulsion layers, and disposed between the polymeric support and the one or more silver halide emulsion layers, a light-insensitive adhesion-promoting layer comprising a polymeric matting agent having an average particle size of at least 1 $\mu$m and up to about 10 $\mu$m and a glass transition temperature of at least 120° C.

In preferred embodiments, the useful polymeric matting agent is composed of a polymer represented by the following Structure I:

$$—(A)_x—(B)_y— \qquad \text{I}$$

wherein A represents recurring units derived from one or more polyfunctional ethylenically unsaturated polymerizable monomers, and B represents recurring units derived from one or more monofunctional ethylenically unsaturated polymerizable monomers, x is from about 5 to 100 weight %, and y is from 0 to about 95 weight %.

In still another preferred embodiment, a photographic silver halide material comprises a polyester support and having on at least one side thereof, one or more silver halide emulsion layers, and disposed between the polyester support and the one or more silver halide emulsion layers, a first light-insensitive adhesion-promoting layer comprising a polymeric matting agent having a average particle size of from about 1.2 to about 3 $\mu$m and a glass transition temperature of at least 135° C., and disposed between the first light-insensitive adhesion-promoting layer and the polyester support, a polymeric latex subbing layer, the polymeric matting agent is composed of a polymer represented by the following Structure I:

$$—(A)_x—(B)_y— \qquad \text{I}$$

wherein A represents recurring units derived from one or more polyfunctional ethylenically unsaturated polymerizable acrylates or methacrylates, and B represents recurring units derived from one or more monofunctional ethylenically unsaturated polymerizable acrylates or methacrylates, x is from about 10 to 30 weight %, and y is from about 70 to about 90 weight %.

This photographic silver halide material may further comprise a protective surface layer over the one or more silver halide emulsion layers, a pelloid layer on the backside of the polyester support, and disposed between the polyester support and the pelloid layer, a second light-insensitive adhesion-promoting layer comprising a polymeric matting agent having a average particle size of from about 1.2 to about 3 $\mu$m and a glass transition temperature of at least 135° C., the polymeric matting agent in the second light-insensitive hydrophilic subbing layer being composed of a polymer represented by the following Structure I:

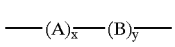

I wherein

A represents recurring units derived from one or more polyfunctional ethylenically unsaturated polymerizable acrylates or methacrylates, and B represents recurring units derived from one or more monofunctional ethylenically unsaturated polymerizable acrylates or methacrylates having only one polymerizable site, x is from about 10 to 30 weight %, and y is from about 70 to about 90 weight %, the polymeric matting agents in the first and second light-insenitive hydrophilic subbing layers being the same or different.

This invention also provides a method of providing an image comprising processing an imagewise exposed photographic silver halide material described above using one or more aqueous photographic processing compositions.

The present invention reduces the equipment maintenance and product waste in the manufacture of film "base" for various photographic silver halide materials. The matting agent particles used in this invention have a higher glass transition temperature from sufficient crosslinking so they have a reduced tendency to soften under the heat treatment conditions used to make such film "base". Moreover, they are large enough in size so they adequately reduce static buildup on the support during manufacturing operations. In addition, the preferred matting agents are prepared from solely acrylate and methacrylate monomers so the resulting polymers are more "transparent" to imaging radiation and because they have an index of refraction similar to hydrophilic binders such as gelatin, thereby reducing light scatter.

DETAILED DESCRIPTION OF THE INVENTION

The polymeric matting agents useful in the present invention are designed to withstand increased temperatures during manufacturing operations and thus have a glass transition temperature ($T_g$) of at least 120° C., preferably of at least 135° C., and more preferably of at least 150° C. Glass transition temperature is a well known characteristic of polymers that can be readily measured using conventional techniques such as differential scanning colorimetry (DSC) at a scanning rate of 20° C./min. wherein the onset in the change in heat capacity is taken as the $T_g$.

One or more ethylenically unsaturated polymerizable monomers are used to prepare the polymeric matting agents, example of which monomers are provided below. It is understood that a skilled worker in the art would readily know how to choose the desired monomers and their proportions to obtain matting agents of the desired glass transition temperature. Representative monomers that homopolymerize to provide polymers having a $T_g$ of at least 120° C. include, but are not limited to (literature $T_g$ values shown in parenthesis), pentachlorophenyl acrylate (147° C.), methacrylic acid (185° C.), cesium acrylate (174° C.), adamantyl methacrylate (141° C.), 4-t-butyl styrene (130° C.), 4-diisopropylstyrene (162° C.), and α-methylstyrene (168° C.).

More particularly, the polymeric matting agent useful in the present invention is represented by the general Structure I noted above. Ethylenically unsaturated monomers that are represented by "A" include ethylenically unsaturated polymerizable compounds that have two or more functional groups that can be polymerized or reacted to form crosslinking sites within the polymer matrix. Thus, such monomers are considered "polyfunctional" with respect to the moieties used for polymerization and crosslinking. Representative monomers of this type include but are not limited to, aromatic divinyl compounds (such as divinylbenzene, divinylnaphthalene, and derivatives thereof), diethylene carboxylate esters (that is, acrylate and methacrylates) and amides (such as ethylene glycol dimethacrylate, diethylene glycol dimethacrylate, triethylene glycol dimethacrylate, ethylene glycol diacrylate, diethylene glycol diacrylate, 1,6-hexanediol dimethacrylate, 1,6-hexanediol diacrylate, pentaerythritol tetraacrylate, neopentyl glycol dimethacrylate, allyl methacrylate, allyl acrylate, butenyl acrylate, undecenyl methacrylate, 1,4-butanediol dimethacrylate, trimethylol propane trimethacrylate, trimethylol propane triacylate, 1,3-dibutanediol dimethacrylate, methylene-bisacrylamide, and hexamethylene-bisacrylamide), dienes (such as butadiene and isoprene), other divinyl compounds such as divinyl sulfide and divinyl sulfone compounds, and other compounds that would be readily apparent to one skilled in the art. Two or more of these monomers can be used to prepare matting agents. The polyfunctional acrylates and methacrylates described above are preferred in the practice of this invention. Ethylene glycol dimethacrylate, 1,6-hexanediol dimethacrylate, 1,6-hexanediol diacrylate, trimethylol propane trimethacrylate, and trimethylol propane triacrylate are particularly preferred. Ethylene glycol dimethacrylate is most preferred.

Monomers that have only one ethylenically unsaturated group (thus, "monofunctional") and that are capable of providing the "B" recurring units include any other known monomer that can be polymerized in suspension polymerization with the monomers defined by the "A" recurring units.

Such monomers include but are not limited to, ethylenically unsaturated hydrocarbons (such as ethylene, propylene, 1-butene, isobutene, styrene, α-methylstyrene, m-chloromethylstyrene, vinyl toluene, vinyl naphthalene, p-methoxystyrene, and hydroxymethylstyrene), ethylenically unsaturated esters of carboxylic acids (such as vinyl acetate, vinyl propionate, vinyl benzoate, vinyl cinnamate, and vinyl butyrate), esters of ethylenically unsaturated mono- or dicarboxylic acid amides (such as acrylamide, methacrylamide, N-methylacrylamide, N-ethylacrylamide, N,N-dimethylacrylamide, N-n-butylacrylamide, N-t-butylacrylamide, itaconic acid diamide, acrylamido-2,2-dimethylpropanesulfonic acid, N-isopropylacrylamide, N-acryloylmorpholine, and N-acryloylpiperidine), monoethylenically unsaturated dicarboxylic acids and their salts (such as acrylic acid, methacrylic acid, itaconic acid, and their salts), monoethylenically unsaturated compounds such as acrylonitrile and methacrylonitrile, vinyl halides (such as vinyl chloride, vinyl fluoride, and vinyl bromide), vinyl ethers (such as vinyl methyl ether, vinyl isobutyl ether, and vinyl ethyl ether), vinyl ketones (such as vinyl methyl ketone, vinyl hexyl ketone, and methyl isopropenyl ketone), acrolein, vinylidene halides (such as vinylidene chloride and vinylidene chlorofluoride), N-vinyl compounds (such as N-vinyl pyrrolidone, N-vinyl pyrrole, N-vinyl carbazole, and N-vinyl indole), and alkyl or aryl esters, amides, and nitriles (that is acrylates and methacrylates, such as methyl methacrylate, methyl acrylate, ethyl methacrylate, ethyl acrylate, n-butyl methacrylate, isobutyl methacrylate, 2-hydroxyethyl acrylate, 2-hydroxyethyl methacrylate, hexyl acrylate, hexyl methacrylate, 2-ethylhexyl acrylate, nonyl methacrylate, benzyl methacrylate, 2-hydroxypropyl methacrylate, and amides and nitriles of the same acids), and other compounds that would be readily apparent to one skilled in the art. Mixtures of such monomers can also be used.

Acrylates and methacrylates are preferred monomers for obtaining the "B" recurring units. Methyl methacrylate, isobutyl methacrylate, and methyl acrylate are particularly preferred and methyl methacrylate is most preferred.

In Structure I noted above, the "A" recurring units are present in an amount of at least 5 weight % and preferably at least 10 weight %, and generally present at an upper limit of 100 weight %, preferably up to 50 weight %, and more preferably up to 30 weight %. The amount of "A" recurring units is represented by "x" in Structure I.

Moreover, the amount of "B" recurring units is represented by "y" may be 0 weight %, but generally it is at least 50 weight %, and preferably at least 70 weight %. The upper limit can be 95 weight %, and more preferably up to 90 weight %.

The particularly useful polymeric matting agents are prepared using one or more polyfunctional acrylates or methacrylates and one or more monofunctional acrylates or methacrylates. Representative useful polymers are as follows (having weight ratios within the described ranges):

poly(methyl methacrylate-co-ethylene glycol dimethacrylate), poly(methyl methacrylate-co-1,6-hexanediol diacrylate), poly(methyl acrylate-co-trimethylol propane triacrylate), poly(isobutyl methacrylate-co-ethylene glycol dimethacrylate), and poly(methyl acrylate-co-1,6-hexanediol diacrylate).

The first listed polymer is most preferred.

The matting agents used in the practice of this invention are generally prepared using suspension polymerization techniques in which a suspension of the two or more monomers described above is formed in water. This may be brought about by passing the dispersion of monomers and water through a mechanical high shear device such as a high pressure homogenizer, a colloid mill, an agitator, or an ultrasonic horn to achieve an oil in water dispersion of monomer droplets.

Preferably, a suspension stabilizing agent is added to water or the monomers prior to the mechanical shearing process in conventional amounts. Any suitable suspension stabilizing agent may be used including for example, anionic particulate suspension stabilizing agents such as silicas, talcs, clays as described for example in U.S. Pat. No. 5,288,598 (Sterman et al.), cationic, anionic, or nonionic surfactants such as sulfonated alkyl aryl polyethers, ethylene glycol ethers of polyhydric alcohols, carboxy alkyl-substituted polyglycol ethers and esters, fluoro-substituted compounds, sucrose esters of aliphatic acids, maleic ester amides, sodium salt of the condensation product of naphthalene sulfonic acid and formaldehyde, phosphates esters of glycidol polyesters, long chain sucrose ethers, higher alcohol sulfates, water soluble salts of aliphatic esters of sulfosuccinic acid, fatty acid esters of hydroxy alkyl sulfonic acids, amide and ester derivatives of sulfoacetic acid, α-sulfo lower alkyl esters of $C_{7-18}$ carbon atoms, fatty acids, and sulfate ester products of glycidol polyether, and others readily apparent to one skilled in the art.

Preferably, a polymerization catalyst or initiator that is soluble in the monomer droplets is used in the preparation of the matting agents in conventional amounts. Typical initiators include peroxide and azo initiators such as 2,2'-azobis (2,4-dimethyl valeronitrile), 2,2'-azobis(isobutyronitrile), lauroyl peroxide, benzoyl peroxide, and others that would be readily apparent to a skilled worker in the art. Chain transfer agents can also be added to the monomers to control the properties of the resulting polymeric particles.

If desired, non-reactive hydrophobic compounds can be added to control particle size of the polymeric matting agent particles, as described in U.S. Pat. No. 5,563,226 (noted above), incorporated herein by reference.

After the high mechanical shearing, polymerization is carried out for conventional times (generally from about 4 to about 24 hours) and at conventional temperatures (generally from about 50 to about 90° C.). The resulting matting agents can optionally be isolated by conventional techniques including filtration, sedimentation under gravity or centrifugal forces, and spray drying.

As one skilled in the art would understand, the suspension polymerization reaction medium and conditions can be controlled to provide the desired average polymer particle size and size distribution. The polymeric matting agents useful in this invention generally have an average particle size of from 1 to about 10 μm, and preferably from about 1.2 to 5 μm, and more preferably from about 1.2 to about 3 μm. "Average particle size" is defined as the statistical average of the measured particle size distribution on a volume basis. Further details concerning particle size measurement are provided by Allen, "Particle Size Measurement", $4^{th}$ Ed., Chapman and Hall (1990).

Mixtures of matting agents composed of various polymers as described above and having different average particle sizes can also be used if desired.

The polymeric matting agents are disposed in a light insensitive adhesion-promoting layer (sometimes called a "subbing" layer) on a polymeric support, usually in admixture with one or more hydrophobic or hydrophilic naturally occurring or synthetic binders such as gelatin and gelatin derivatives, various proteins and protein derivatives, cellulosic materials, synthetic acrylamide polymers, maleic anhydride polymers, acrylic and methacrylic acid polymers, poly(vinyl alcohol), and mixtures thereof Many other suitable binder materials are well known in the art. Hydrophilic binder materials are preferred, and gelatin and gelatin derivatives are most preferred. Thus, hydrophilic layers are preferred in the practice of this invention.

Within the light insensitive adhesion-promoting layer, the polymeric matting agent generally comprises at least 0.01 weight % and preferably at least 1 weight %, based on total dry layer weight. More preferably, the amount of matting agent is from about 0.1 to about 1.5 weight %. The binder(s) comprise essentially the reminder of the layer except for any optional surfactants, biocides, hardeners, and other addenda.

As noted above, the light insensitive adhesion-promoting layer is disposed between the support and the one or more silver halide emulsion layers on one or both sides of the support. More preferably, a latex subbing layer (described below) is interposed between a light insensitive adhesion-promoting layer and the support. Where a second light insensitive adhesion-promoting layer is used on the "back-side" (usually non-emulsion side) of the support, it may also be applied over a latex subbing layer or disposed directly on the support. One or more other light insensitive layers (such as pelloid or protective overcoat layers) can be disposed on the second light insensitive adhesion-promoting layer.

Where a light insensitive adhesion-promoting layer is present on both sides of the support, the respective layers can comprise the same or different binders and/or matting agents, and can have the same or different thickness.

The polymeric support materials used in the materials of this invention can be any polymeric film that is known in the art. Various support materials include but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are polyesters. Polyethylene terephthalate and polyethylene naphthalate films are the most preferred support. Various support materials are described, for example, in *Research Disclosure,* August 1979, item 18431. A method of making dimensionally stable polyester films is described in *Research Disclosure,* September, 1999, item 42536.

Support materials can contain various colorants, pigments, antihalation or acutance dyes if desired. Support materials may be treated using conventional procedures (such as corona discharge or plasma treatment) to improve adhesion of overlying layers, or subbing or other adhesion-promoting layers can be used. Particularly, useful subbing layer formulations include those conventionally used for photographic materials such polymeric latex subbing formulations including vinylidene halide polymers such as poly(acrylonitrile-co-vinylidene chloride-co-acrylic acid) and poly(methacrylamide-co-vinylidene chloride-co-acrylic acid). Thus, in some preferred embodiments, the photographic materials comprise a polymeric latex subbing layer disposed between the support and other layers (such as the subbing layers).

Support materials may be heat treated and/or stretched using conventional techniques to provide dimensional stability in the resulting photographic materials.

The photographic silver halide materials of this invention can differ widely in structure and layer composition except for the essential placement of the matte-containing adhesion-promoting layers between the support and overlying layers on one or both sides of the support and the presence of one or more image-forming silver halide emulsion layers. For example, the materials can vary with respect to the number and types of layers on each side of the support. Some materials may have one or more silver halide emulsion layers to provide a black-and-white or color image on one side of the support only. Other materials may have one or more silver halide emulsions layers to provide color or black-and-white images on both sides of the support. In those embodiments, the silver halide emulsion layers can be the same or different on both sides of the support.

The photographic silver halide materials can be color or black-and-white negative films, reversal films, motion picture films, radiographic (industrial, medical, or dental) films, graphic arts films, microfilms, or other silver halide materials containing a polymeric support that would be readily apparent to one skilled in the photographic arts. Preferably, the photographic silver halide materials are used to provide black-and-white images and are more preferably radiographic films. Moreover, the photographic silver halide materials of this invention can be incorporated into what are known as "one-time-use" cameras in which the photographic silver halide film is incorporated into a suitable camera shell containing a lens and an outer wrapping of some type.

The silver halide emulsion layers can contain one or more silver halides such as silver chloride, silver bromide, silver bromoiodide, silver chlorobromide, and others well known in the art. Any of the known silver halide emulsion layers, such as those described in *Reseach Disclosure,* Vol. 176, Item 17643 (December, 1978) and *Reseach Disclosure,* Vol. 225, Item 22534 (January, 1983), and *Reseach Disclosure,* Item 36544 (September, 1994), and *Reseach Disclosure,* Item 37038 (February, 1995) and the references cited therein are useful in preparing photographic materials in accordance with this invention.

Examples of representative color negative films of the present invention include, but are not limited to, KODAK ROYAL GOLD Color Films, KODAK MAX Color Films, KODAK ADVANTiX Color Films, KODAK VERICOLOR III Color Films, KONICA VX400 Color Film, KONICA Super SR400 Color Film, FUJI SUPER Color Films, LUCKY Color Films, and other commercial products currently on the market. Color negative films used in "one-time-use" cameras are also included in the present invention.

The black-and-white photographic silver halide materials of the present invention are generally composed of a conventional flexible, transparent film support (noted above) that has applied to each side one or more photographic silver halide emulsion layers. For radiographic films, it is conventional to use blue-tinted polyester support films to contribute to the blue-black image tone sought in fully processed films. Polyethylene terephthalate and polyethylene naphthalate are preferred radiographic film supports.

In general, such elements, emulsions, and layer compositions are described in many publications, including *Reseach Disclosure,* publication 36544, September 1994. *Research Disclosure* is a publication of Kenneth Mason Publications, Ltd., Dudley House, 12 North Street, Emsworth, Hampshire PO10 7DQ England.

The photographic materials include one or more silver halide emulsion layers that comprise one or more types of silver halide grains responsive to suitable electromagnetic radiation. Such emulsions include silver halide grains composed of, for example, silver bromide, silver iodobromide, silver chlorobromide, silver iodochlorobromide, and silver chloroiodobromide, or any combinations thereof. The silver halide grains in each silver halide emulsion unit (or silver halide emulsion layers) can be the same or different, or mixtures of different types of grains.

The silver halide grains can have any desired morphology (for example, cubic, tabular, octahedral), or mixtures of grains of various morphologies. In some embodiments, at least 50% (and preferably at least 70%) of the silver halide grain projected area is provided by tabular grains having an average aspect ratio greater than 8, and preferably greater than 12.

Imaging contrast can be raised by the incorporation of one or more contrast enhancing dopants. Rhodium, cadmium, lead and bismuth are all well known to increase contrast by restraining toe development. Rhodium is most commonly employed to increase contrast and is specifically preferred.

A variety of other dopants are known individually and in combination, to improve contrast as well as other common properties, such as speed and reciprocity characteristics. Dopants capable providing "shallow electron trapping" sites commonly referred to as SET dopants are specifically contemplated. SET dopants are described in *Reseach Disclosure,* Vol. 367, November 1994, Item 36736. Iridium dopants are very commonly employed to decrease reciprocity failure. A summary of conventional dopants to improve speed, reciprocity and other imaging characteristics is provided by *Reseach Disclosure,* Item 36544, cited above, Section I. Emulsion grains and their preparation, sub-section D. Grain modifying conditions and adjustments, paragraphs (3), (4) and (5).

The emulsions can be chemically sensitized by any convenient conventional technique as illustrated by *Reseach Disclosure,* Item 36544, Section IV. Chemical sensitization. Sulfur and gold sensitization is specifically contemplated.

The silver halide emulsion and other layers forming the layers on the support contain conventional hydrophilic colloid vehicles (peptizers and binders) that are typically gelatin or a gelatin derivative (identified herein as "gelatino-vehicles"). Conventional gelatino-vehicles and related layer features are disclosed in *Reseach Disclosure,* Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin). Depending upon the use of the materials, the binder-containing layers can be hardened or unhardened.

Some photographic silver halide materials of this invention can include a protective surface overcoat on each side of the support that are typically provided for physical protection of the emulsion layers. This overcoat layer may be known as a "pelloid" layer on the backside and comprises suitable binders, matting agents and/or conductive agents. In addition to vehicle features discussed above the overcoats can contain various addenda to modify the physical properties of the overcoats. Such addenda are illustrated by *Reseach Disclosure,* Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Examples of black-and-white films of the present invention include, but are not limited to, KODAK TRI-X-PAN Black and White Film, KODAK PLUS X-PAN Black and White Film, KODAK TMAX 100 and 400 speed Black and White Films, various KODAK T-MAT Radiographic Films, various KODAK INSIGHT Radiographic Films, KODAK X-OMAT Duplicating Film, various KODAK EKTASCAN Radiographic Films, KODAK CFT, CFL, CFS and CFE Radiographic Films, KODAK X-Sight Radiographic Films, KODAK InSight Radiographic Films, KODAK MinR and MinR-L Mammography Films, KODAK EKTASPEED and EKTASPEED PLUS Dental Films, and KODAK ULTRASPEED Dental Film.

Many of the noted radiographic films can be prepared using the details provided in U.S. Pat. No. 5,876,913 (Dickerson et al.), U.S. Pat. No. 5,824,459 (Dickerson), U.S. Pat. No. 4,994,355 (Dickerson et al.), U.S. Pat. No. 5,856,077 (Dickerson et al.), U.S. Pat. No. 6,037,112 (Dickerson), U.S. Pat. No. 5,952,162 (Dickerson et al.), U.S. Pat. No. 5,925,505 (Baugher et al.), and U.S. Pat. No. 5,871,892 (Dickerson et al.), all of which patents are incorporated herein by reference. Thus, the radiographic materials described in these patents can include a light-insensitive adhesion-promoting layer (preferably a hydrophilic layer) containing polymeric matting agents with a glass transition temperature of at least 120° C., preferably a crosslinked polymeric matting agent as described herein, on one or both sides of the support and underneath other layers such as silver halide emulsion layers.

Color reversal films of this invention are comprised of a support having thereon a plurality of photosensitive silver halide emulsion layers that can contain any conventional silver halide (or mixture thereof). Such films generally have silver halide emulsions having at least 1 mol % iodide based on total silver. Some specific commercially available color reversal photographic films that can be processed using this invention include EKTACHROME and KODACHROME Color Reversal Films (Eastman Kodak Company), FUJICHROME Color Reversal Films (Fuji Photo Film Co., Ltd.), AGFACHROME Color Reversal Films (AGFA), and KONICACHROME Color Reversal Films (Konica).

The various photographic silver halide materials of this invention are imagewise exposed in a suitable fashion and then "wet" processed with one or more aqueous photographic processing compositions to provide the desired color or black-and-white image.

Color images are usually obtained using a sequence of processing steps that are well known in the art and include color development, bleaching, and fixing (or bleach/fixing) steps as a minimum. Useful processing steps, conditions and materials useful therein are well known for the various processing protocols including the conventional Process C-41 processing of color negative films and Process E-6 for processing color reversal films (see for example, *Research Disclosure* publication 38957 noted above).

Black-and-white images are usually more simply obtained with development and fixing steps such as well known from considerable literature such as U.S. Pat. No. 5,021,327 (Bunch et al.) and U.S. Pat. No. 5,576,156 (Dickerson) for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), and U.S. Pat. No. 5,942,378 (Fitterman et al), all incorporated herein by reference. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al).

The compositions of this invention can be used in both what are known as "slow access" and "rapid access" processing methods and equipment. For example, black-and-white motion picture films, industrial radiographic films and professional films and papers are generally developed over a longer period of time (for example, for at least 1 minute and up to 12 minutes). Total processing including other steps (for example fixing and washing) would be even longer.

"Rapid access" methods are generally used to process medical radiographic X-ray films, graphic arts films and microfilms and development may be at least 10 seconds and up to 60 seconds (preferably from about 10 to about 30 seconds). The total processing time (for example including fixing and washing) is as short as possible, but generally from about 20 to about 120 seconds. An example of a "rapid access" system is that commercially available as the KODAK RP X-OMAT™ processing system that also includes a conventional photographic fixing composition.

Polymeric Matting Agent Synthesis

Synthesis of Matting Agent 1

To a 40 liter vessel were added the following ingredients: 6.0 kg of methyl methacrylate and 1.5 kg of ethylene glycol dimethacrylate as a monomer mixture, 15.0 g of dioctyl ester of sodium sulfosuccinic acid (AEROSOL OT-100® surfactant), and 82.5 g of lauroyl peroxide polymerization initiator. The ingredients were stirred until all the solids were dissolved.

To this solution was added 22.5 kg of demineralized water and the mixture was then stirred for 5 minutes to form a crude emulsion. The crude emulsion was passed through a GAULIN® colloid mill set at 3670 rev./min., 0.18-mm gap, and 5.7 kg/minute throughput. The resulting monomer droplet dispersion was placed into a 40-liter reactor and heated to 55° C. while stirring at 25 rev./min. under positive pressure nitrogen for 16 hours to polymerize the monomer droplets into polymeric matte particles. The slurry was then heated to 80° C. for four hours followed by cooling to 25° C. The product was filtered through a cheese cloth bag yielding 28 kg of slurry. Particle size was measured using a Horiba LA-920® and found to be 1.5 μm median diameter and glass transition temperature was measured by the method of differential scanning calorimetry (DSC) at a scanning rate of 20° C. and found to be 171° C.

Synthesis of Matting Agent 2

This matting agent was prepared by essentially the same method as described above for Matting Agent 1 except that the monomer mixture was 90% (weight) of methyl methacrylate and 10% (weight) of ethylene glycol dimethacrylate. Particle size was measured using a Horiba LA-920® and found to be 3.2 μm median diameter and the glass transition temperature was measured by the method of differential scanning calorimetry (DSC) at a scanning rate of 20° C. and found to be 149° C.

Synthesis of Matting Agent 3

This matting agent was prepared by essentially the same method as described above for Matting Agent 1 except that the monomer mixture was 50% (weight) of methyl methacrylate and 50% (weight) of ethylene glycol dimethacrylate. Particle size was measured using a Horiba LA-920® and found to be 1.7 μm median diameter and the glass transition temperature was measured by the method of differential scanning calorimetry (DSC) at a scanning rate of 20° C. and found to be too high to measure.

Synthesis of Matting Agent 4

This matting agent was prepared by essentially the same method as described above for Matting Agent 1 except that the monomer mixture was 80% (weight) of vinyl toluene and 20% (weight) of divinylbenzene. Particle size was measured using a Horiba LA-920® and found to be 1.3 μm median diameter and the glass transition temperature was measured by the method of differential scanning calorimetry (DSC) at a scanning rate of 20° C. and found to be 125° C.

Synthesis of Matting Agent 5

This matting agent was prepared by essentially the same method as described above for Matting Agent 1 except that the monomer mixture was 60% (weight) of methyl methacrylate and 40% (weight) of methacrylic acid. Particle size was measured using a Horiba LA-920® and found to be 1.9 μm median diameter and the glass transition temperature was measured by the method of differential scanning calorimetry (DSC) at a scanning rate of 20° C. and found to be 152° C.

Synthesis of Matting Agent 6

To a 200-liter vessel were added 41 kg of styrene and 17.7 kg of divinylbenzene as monomers, and 1.06 kg of benzoyl peroxide polymerization initiator. The ingredients were stirred until all of the solids were dissolved.

In a separate 200-liter vessel were added 93 kg of demineralized water, 37 g of potassium dichromate, 400 g of poly(dithanolamine adipate), and 4.96 kg of LUDOX® colloidal silica (DuPont). The monomer mixture was added to this aqueous phase and stirred for 15 minutes to form a crude emulsion. The crude emulsion was passed through a CREPACO® homogenizer at a pressure of 350 kg/cm$^2$. The resulting monomer droplet dispersion was placed into a 200-liter reactor and heated to 65° C. while being stirred at 30 rev/min under positive pressure nitrogen for 16 hours to polymerize the monomer droplets into polymeric matting agent particles. The slurry was then heated to 85° C. for four hours followed by cooling to 250° C. The product was filtered through a 400-mesh screen to remove oversized particles. Particle size was measured using a Horiba LA-920® and found to be 6 μm median diameter and the glass transition temperature was measured by the method of differential scanning calorimetry (DSC) at a scanning rate of 20° C. and found to be 162° C.

Synthesis of Control Matting Agent A

This matting agent was prepared by essentially the same method as described above for Matting Agent 1 except that 100% (weight) of methyl methacrylate was used. Particle size was measured using a Horiba LA-920® and found to be 1.5 μm median diameter and the glass transition temperature was measured by the method of differential scanning calorimetry (DSC) at a scanning rate of 20° C. and found to be 105° C.

EXAMPLES 1–5

Preparation of Photographic Silver Halide Materials

Both black-and-white and color photographic materials were prepared according to the present invention.

Samples of polyethylene terephthalate film support were coated with a light-insensitive adhesion-promoting layers prepared by mixing the polymeric matting agents shown in TABLE I below in conventional gelatin binder. Each adhesion-promoting layer formulation was prepared by mixing the appropriate amount of matting agent in gelatin (7.43 g) in water (588.6 g). Each formulation also included a conventional biocide and surfactant, potassium acetate (1.49 g), chrome alum (0.02 g), and saponin (0.184 g at 45.6% solids).

TABLE I

| Example | Matting Agent | Particle Size (μm) | $T_g$ (° C.) | Matting Agent % Solids |
|---|---|---|---|---|
| Examples 1A & B | Matting Agent 3 | 1.7 | over 120° C. | 24.2% |
| Examples 2A & B | Matting Agent 2 | 3.2 | 149° C. | 40% |
| Examples 3A & B | Matting Agent 4 | 1.3 | 125° C. | 30% |
| Examples 4A & B | Matting Agent 6 | 6 | 162° C. | 40% |

TABLE I-continued

| Example | Matting Agent | Particle Size (μm) | $T_g$ (° C.) | Matting Agent % Solids |
|---|---|---|---|---|
| Examples 5A & B | Matting Agent 5 | 1.9 | 152° C. | 20% |
| Control | Matting Agent 1 | 1.5 | 105° C. | 40% |

Each coated film support was then coated with a silver halide emulsion and dried to form light-sensitive photographic silver halide materials (films).

Examples 1A, 2A, 3A, 4A, and 5A were coated with a conventional black-and-white radiographic emulsion comprising green-sensitized tabular silver bromide grains in a gelatin binder (1.59:1 gelatin to silver weight ratio). The total silver coverage was about 1.6 g of silver per square meter.

Examples 1B, 2B, 3B, 4B, and 5B were coated with a conventional color negative forming emulsion comprising red-sensitized tabular silver bromide grains in a gelatin binder (1.59:1 gelatin to silver weight ratio). The total silver coverage was about 1.6 g of silver per square meter.

Similar Control A (blank-and-white) and B (color negative) photographic film samples were prepared using Control Matting Agent A in the adhesion-promoting layer on the polyethylene terephthalate film support.

After drying, half of each of the film samples was exposed to white light to provide an optical density of from 1.4 to 1.0. The other half of each of the film samples was left unexposed. The film samples were then wet processed using the appropriate conventional processing solutions and conditions. Densitometry readings were taken at three random locations in both the exposed and unexposed regions of each processed film sample, and the sensitometric data is provided in TABLE II below. It is apparent that the matting agents used in the practice of the present invention did not adversely affect sensitometric results and are well suited for use in adhesion-promoting layers.

In addition, while the Control film containing Matting Agent 1 exhibited buildup of debris on the coating equipment causing impressions in the passing web, the matting agents within the scope of the present invention provided acceptable coating and imaging results.

TABLE II

| Example | Matting Agent | Unexposed Density | Exposed Density |
|---|---|---|---|
| Control A | Control Matting Agent A | 0.08 | 1.8 |
| Example 1A | Matting Agent 3 | 0.08 | 1.92 |
| Example 2A | Matting Agent 2 | 0.08 | 1.94 |
| Example 3A | Matting Agent 4 | 0.08 | 1.82 |
| Example 4A | Matting Agent 6 | 0.08 | 1.91 |
| Example 5A | Matting Agent 5 | 0.08 | 1.75 |
| Control B | Control Matting Agent A | 0.07 | 1.41 |
| Example 1B | Matting Agent 3 | 0.07 | 1.50 |
| Example 2B | Matting Agent 2 | 0.07 | 1.38 |
| Example 3B | Matting Agent 4 | 0.07 | 1.43 |
| Example 4B | Matting Agent 6 | 0.07 | 1.51 |
| Example 5B | Matting Agent 5 | 0.07 | 1.46 |

The invention has been described in detail with particular reference to certain preferred embodiments thereof, but it will be understood that variations and modifications can be effected within the spirit and scope of the invention.

We claim:

1. A photographic silver halide material comprising a polymeric support and having on at least one side thereof, one or more silver halide emulsion layers, and disposed between said polymeric support and said one or more silver halide emulsion layers, a light insensitive adhesion-promoting layer comprising a polymeric matting agent having an average particle size of at least 1 μm and up to about 10 μm and a glass transition temperature of at least 120° C.

2. The photographic silver halide material of claim 1 wherein said polymeric matting agent has a glass transition temperature of at least 145° C.

3. The photographic silver halide material of claim 1 wherein said polymeric matting agent is composed of a polymer represented by the following Structure I:

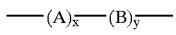

I wherein A represents recurring units derived from one or more polyfunctional ethylenically unsaturated polymerizable monomers, and B represents recurring units derived from one or more monofunctional ethylenically unsaturated polymerizable monomers, x is from about 5 to 100 weight %, and y is from 0 to about 95 weight %.

4. The photographic silver halide material of claim 3 wherein A represents recurring units derived from one or more polyfunctional ethylenically unsaturated acrylates or methacrylates.

5. The photographic silver halide material of claim 3 wherein B represents recurring units derived from one or more monofunctional ethylenically unsaturated acrylates or methacrylates.

6. The photographic silver halide material of claim 3 wherein x is from about 10 to about 50 weight % and y is from about 50 to about 90 weight %.

7. The photographic silver halide material of claim 6 wherein x is from about 10 to about 30 weight % and y is from about 70 to about 90 weight %.

8. The photographic silver halide material of claim 1 wherein said polymeric support is a polyester film support.

9. The photographic silver halide material of claim 8 wherein said polymeric support is composed of polyethylene terephthalate or polyethylene naphthalate.

10. The photographic silver halide material of claim 1 wherein said polymeric matting agent has an average particle size of from about 1.2 to about 5 μm.

11. The photographic silver halide material of claim 10 wherein said polymeric matting agent has an average particle size of from about 1.2 to about 3 μm.

12. The photographic silver halide material of claim 1 comprising one or more black-and-white silver halide emulsion layers disposed over said light-insensitive adhesion-promoting layer.

13. The photographic silver halide material of claim 1 further comprising a surface protective layer disposed over said one or more silver halide emulsion layers.

14. The photographic silver halide material of claim 1 wherein said light insensitive adhesion-promoting layer is a light-insensitive hydrophilic subbing layer.

15. The photographic silver halide material of claim 14 wherein said light-insensitive hydrophilic subbing layer comprises a gelatin or a gelatin derivative binder.

16. The photographic silver halide material of claim 1 further comprising a hydrophilic polymeric latex subbing layer between said light insensitive adhesion-promoting layer and said support.

17. The photographic silver halide material of claim 1 further comprising a second light insensitive adhesion-promoting layer on the backside of said polymeric support, said second light insensitive adhesion-promoting layer comprising the same or different polymeric matting agent having an average particle size of at least 1 $\mu$m and up to about 10 $\mu$m and a glass transition temperature of at least 120° C.

18. The photographic silver halide material of claim 17 wherein said polymeric matting agent in said second light insensitive adhesion-promoting layer is composed of a polymer represented by the following Structure I:

$$\text{—}(A)_x\text{—}(B)_y\text{—} \qquad \text{I}$$

wherein A represents recurring units derived from one or more polyfunctional ethylenically unsaturated polymerizable monomers, and B represents recurring units derived from one or more monofunctional ethylenically unsaturated polymerizable monomers, x is from about 5 to 100 weight %, and y is from 0 to about 95 weight %.

19. The photographic silver halide material of claim 1 wherein said polymeric matting agent is present in said light insensitive adhesion-promoting layer in an amount of at least 0.01 weight %.

20. The photographic silver halide material of claim 19 wherein said polymeric matting agent is present in said light insensitive adhesion-promoting layer in an amount of from about 0.01 to about 1.5% based on layer dry weight.

21. A photographic silver halide material comprising a polyester support and having on at least one side thereof, one or more silver halide emulsion layers, and disposed between said polyester support and said one or more silver halide emulsion layers, a first light insensitive adhesion-promoting layer comprising a polymeric matting agent having a average particle size of from about 1.2 to about 3 $\mu$m and a glass transition temperature of at least 135° C., and disposed between said first light insensitive adhesion-promoting layer and said polyester support, a polymeric latex subbing layer, said polymeric matting agent is composed of a polymer represented by the following Structure I:

$$\text{—}(A)_x\text{—}(B)_y\text{—} \qquad \text{I}$$

wherein A represents recurring units derived from one or more polyfunctional ethylenically unsaturated polymerizable acrylates or methacrylates, and B represents recurring units derived from one or more monofunctional ethylenically unsaturated polymerizable acrylates or methacrylates, x is from about 10 to 30 weight %, and y is from about 70 to about 90 weight %.

22. The photographic silver halide material of claim 21 further comprising a protective surface layer over said one or more silver halide emulsion layers, a pelloid layer on the backside of said polyester support, and disposed between said polyester support and said pelloid layer, a second light-insensitive adhesion-promoting layer comprising a polymeric matting agent having a average particle size of from about 1.2 to about 3 $\mu$m and a glass transition temperature of at least 135° C., said polymeric matting agent in said second light-insensitive adhesion-promoting layer being composed of a polymer represented by the following Structure I:

$$\text{—}(A)_x\text{—}(B)_y\text{—} \qquad \text{I}$$

wherein A represents recurring units derived from one or more polyfunctional ethylenically unsaturated polymerizable acrylates or methacrylates, and B represents recurring units derived from one or more monofunctional ethylenically unsaturated polymerizable acrylates or methacrylates having only one polymerizable site, x is from about 10 to 30 weight %, and y is from about 70 to about 90 weight %, said polymeric matting agents in said first and second light-insensitive adhesion-promoting layers being the same or different.

23. The photographic silver halide material of claim 22 wherein said first and second light-insensitive adhesion-promoting layers comprise the same polymeric matting agent.

24. The photographic silver halide material of claim 22 further comprising a polymeric latex subbing layer between said second light-insensitive adhesion-promoting layer and said polyester support.

25. A method of providing an image comprising processing an imagewise exposed photographic silver halide material using one or more aqueous photographic processing compositions, said photographic silver halide material comprising a polymeric support and having on at least one side thereof, one or more silver halide emulsion layers, and disposed between said polymeric support and said one or more silver halide emulsion layers, a light insensitive adhesion-promoting layer comprising a polymeric matting agent having an average particle size of at least 1 $\mu$m and up to about 10 $\mu$m and a glass transition temperature of at least 120° C.

* * * * *